United States Patent [19]

Castelluzzo

[11] Patent Number: 4,941,260

[45] **Date of Patent: * Jul. 17, 1990**

[54] UTILITY KNIFE

[76] Inventor: James Castelluzzo, 188 Avenue of the Americas, New York, N.Y. 10013

[ * ] Notice: The portion of the term of this patent subsequent to Mar. 21, 2006 has been disclaimed.

[21] Appl. No.: 284,991

[22] Filed: Dec. 15, 1988

Related U.S. Application Data

[63] Continuation of Ser. No. 894,676, Aug. 8, 1986, Pat. No. 4,813,132.

[51] Int. Cl.[5] ..... B26B 29/02

[52] U.S. Cl. ..... 30/162; 30/335

[58] Field of Search ..... 30/125, 162, 320, 335, 30/339

[56] References Cited

U.S. PATENT DOCUMENTS

| | | | |
|---|---|---|---|
| 2,467,481 | 4/1949 | Huff | 30/342 X |
| 3,660,896 | 5/1972 | Umholtz | 30/162 |
| 4,277,888 | 7/1981 | Szabo | 30/162 |
| 4,517,741 | 5/1985 | Castelluzzo | 30/335 X |
| 4,813,132 | 3/1989 | Castelluzzo | 30/162 |

*Primary Examiner*—Douglas D. Watts

*Attorney, Agent, or Firm*—Lerner, David, Littenberg, Krumholz & Mentlik

[57] ABSTRACT

A utility knife employs a slide having a cantilevered lever for capturing a blade therein. A leading blade in a reservoir is capturable by the slide using a tooth resiliently affixed to the slide which is positioned to enter a locking hole in the blade. The tooth may be withdrawn from the hole in the blade whereby the blade may be removed for reversal and reinsertion or for discard. When the captured blade is removed, the slide may be returned to the loading position for capturing the next blade from the reservoir. As long as a captured blade is engaged by the tooth, the slide is prevented from returning to the loading position, and the loading blade in the reservoir is prevented from advancing.

24 Claims, 5 Drawing Sheets

FIG. 19
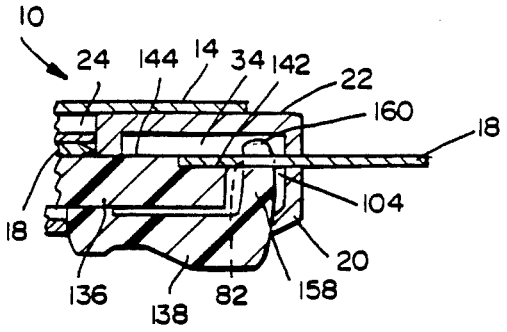
FIG. 21
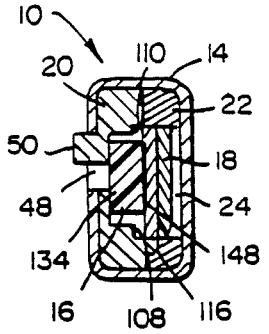
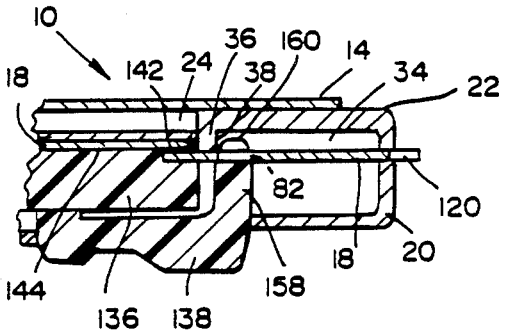
FIG. 20
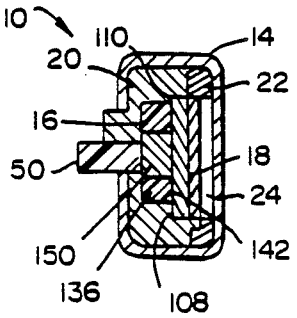
FIG. 22
FIG. 23
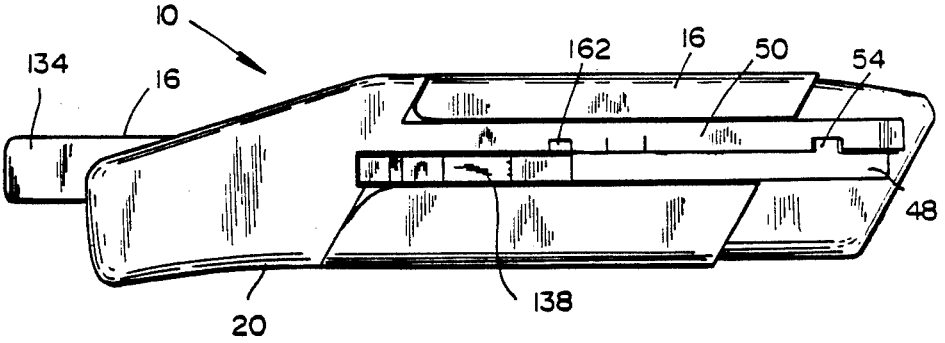

UTILITY KNIFE

This is a continuation of application Ser. No. 894,676, filed Aug. 8, 1986, now U.S. Pat. No. 4,813,132.

BACKGROUND OF THE INVENTION

The present invention relates to cutting utensils and, more particularly, to knives of a type conventionally known as utility knives.

Utility knives are widely used in construction, business and hobby applications for cutting such materials as paper board, wallboard, string, and other objects. In a common embodiment, such utility knives have a handle into which is fitted a trapezoidal blade. The blade has a single cutting edge joining the adjacent edges in acute angles.

As commonly used, such a utility knife includes means for clamping the blade in the handle with one of a portion of the cutting edge and one of the adjacent sides partially exposed whereby cutting is enabled on any part of the exposed edge. In many applications, the portion of the edge at the junction with the acute angle is most used. This portion becomes dulled before the remainder of the blade.

Once the cutting edge revealed in one clamping position becomes dulled, the blade is removed and rotated end for end to place in use the other end of the cutting edge adjacent the opposed acute angle. When the cutting edge at the second end of the blade becomes dulled, the blade is generally discarded and replaced with another blade.

Most utility knives employ a screw or similar means for clamping a single blade in one end thereof with the desired portion revealed. When the revealed edge becomes worn, the screw is removed to release the blade for turning end for end. Such installation and reversal of the blade is time consuming and requires the availability of a screwdriver, or other auxiliary tool.

Prior patents have disclosed knives with a supply of blades in their handles. One such knife, disclosed in U.S. Pat. No. 3,660,896, the disclosure of which is herein incorporated by reference, employs a spring urging a stack of blades from a reservoir into a position where the leading blade can be moved into an operating position. The spring exerts an urging force on the blade stack which varies in accordance with the number of blades in the stack. That is, when several blades are present in the stack, the spring is compressed more tightly and thus exerts a greater force on the stack than when only a single blade is present. The variable force makes the operation of this device less positive than is desirable.

My prior U.S. Pat. No. 4,517,741, the disclosure of which is herein incorporated by reference, solves the variable-force problem of the above reference by employing a permanent magnet in a blade slide facing the blade reservoir. The leading blade in the blade reservoir is attracted into the blade slide with a force dependent upon the strength of the permanent magnet regardless of the number of blades in the reservoir.

OBJECTS AND SUMMARY OF THE INVENTION

It is an object of the invention to provide a utility knife which overcomes the drawbacks of the prior art.

It is a still further object of the invention to provide a utility knife including trigger means permitting removal, reversal and reinsertion of a blade in a utility knife.

It is a still further object of the invention to provide a utility knife having a blade reservoir in a handle thereof and means for advancing a leading blade into an operating position protruding from the handle.

It is a still further object of the invention to provide a utility knife having a blade reservoir capable of containing a stack of blades in the handle thereof, means for capturing and advancing a leading blade into an operating position, and means for preventing other blades in the stack from interfering with operation of the utility knife so long as one blade is captured in the means for capturing and advancing.

It is a still further object of the invention to provide a utility knife having a minimum number of separate parts.

It is a still further object of the invention to provide a utility knife capable of being snapped together without requiring screw-type fasteners.

Briefly stated, the present invention provides a utility knife employing a slide having a cantilevered lever for capturing a blade therein. A leading blade in a reservoir is capturable by the slide using a tooth resiliently affixed to the slide which is positioned to enter a locking hole in the blade. The tooth may be withdrawn from the hole in the blade whereby the blade may be removed for reversal and reinsertion or for discard. When the captured blade is removed, the slide may be returned to the loading position for capturing the next blade from the reservoir. As long as a captured blade is engaged by the tooth, the slide is prevented from returning to the loading position, and the leading blade in the reservoir is prevented from advancing.

According to an embodiment of the invention, there is provided a knife comprising: a handle, means in the handle for slidably receiving a blade, a slide in the handle, means for permitting the slide to move in the handle between at least first and second positions, engagement means on the slide for engaging cooperating means on the blade, means for establishing first and second conditions of the engagement means, the first condition being effective for engaging the engagement means with the cooperating means and the second condition being effective for releasing engagement between the engagement means and the cooperating means, and means effective during the first condition for locking the slide in at least first and second positions, the first position being an operating position wherein the blade, if engaged, is advanced into an operating position, and the second position being a retracted position wherein the blade, if engaged, is retracted to a retracted position.

According to a feature of the invention, there is provided a knife comprising: a handle, the handle including first and second halves, a slide, means in the handle for containing a substantial part of the slide, means for permitting the blade slide to be moved between at least first and second positions in the handle, cooperating means between the blade slide and a blade for engaging and releasing the blade, a sleeve fittable over the handle, and the sleeve when fitted over the first and second halves including means for retaining the first and second halves and the slide in an assembled condition.

According to a further feature of the invention, there is provided a knife employing removable blades, comprising: a handle, the handle including first and second halves, the first half including a blade reservoir effective for receiving at least first and second blades, a slide, the second half including means for receiving the slide, the means for receiving facing the blade reservoir, a longitudinal slot in the second half, a lever on the slide, the lever extending at least partly through the slot, the slide and the second half including means for permitting the slide to move between a loading and a selectable one of a plurality of operative positions, means on the slide in the loading position for receiving a leading one of the at least first and second blades from the reservoir, means on the slide for moving the leading one of the at least first and second blades from the loading position to the selectable one of the plurality of operative positions, cooperating means on the slide and at least one of the first and second halves for preventing the slide from being moved to the loading position while it is in any one of its plurality of operative positions, and means for preventing a second of the at least first and second blades from being engaged by the slide while the slide is in any one of its plurality of operative positions.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 19 is a cross section taken along XIX—XIX in FIG. 1 showing an operative position at one extreme of motion of the slide.

FIG. 20 is a cross section similar to that in FIG. 19 except showing the opposite limit of operative motion of the slide.

FIG. 21 is a cross section taken along XXI—XXI in FIG. 1 with the slide in its operative position blocking the exit of the leading blade from the trapezoidal reservoir.

FIG. 22 is a cross section similar to that in FIG. 21 except with the slide in its loading position permitting the leading blade to exit the trapezoidal reservoir for engagement on the slide.

FIG. 23 is a side view of the utility knife according to an embodiment of the invention with the slide in its loading position and a portion of the tail of the slide extending outside the body.

DETAILED DESCRIPTION OF THE PREFERRED EMBODIMENT

Figure 1:
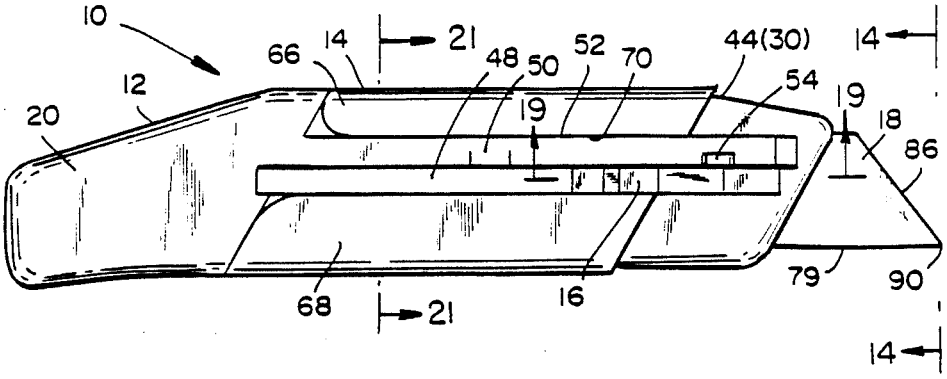
FIG. 1 is a side view of a utility knife in accordance with an embodiment of the invention.

Referring to FIG. 1, there is shown, generally at 10, a utility knife according to an embodiment of the invention. Utility knife 10 includes a body 12 consisting of two parts, to be later described, held together by a sleeve 14. A slide 16, only partly visible in the figure, controls the position of a blade 18.

Good engineering design conventionally attempts to attain maximum function using a minimum amount of material. It is contemplated that parts of utility knife 10 will contain cavities and stiffening webs for reducing the amount and weight of material without sacrificing performance. Such cavities and webs are conventional and the added complication occasioned by their inclusion herein would interfere with an understanding of the invention. Thus, except where it bears a relationship to the invention herein, such structure is omitted.

Figure 2:
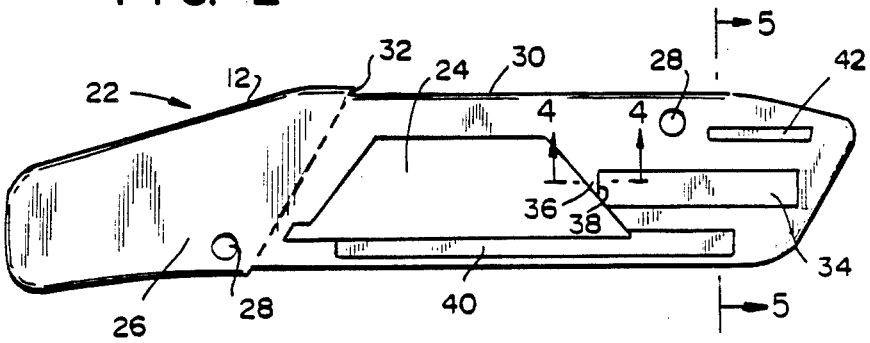
FIG. 2 is a side view of a reservoir portion of FIG. 1.
Figure 3:
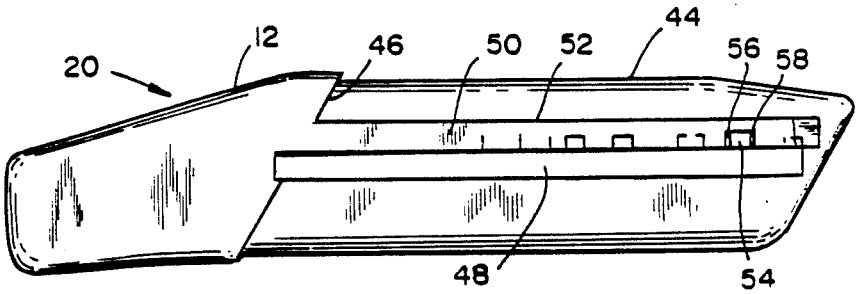
FIG. 3 is a side view of a blade-slide portion of FIG. 1.

Referring now to FIGS. 2 and 3, body 12 consists of a blade-slide portion 20 (also visible in FIG. 1) and a reservoir portion 22, fitted face to face and held in that position by sleeve 14 (FIG. 1) slid thereupon.

Reservoir portion 22 includes a trapezoidal reservoir 24 passing completely therethrough. A generally planar face 26 includes a plurality of cylindrical cavities 28 for engagement by matching cylindrical posts (not shown) protruding from blade-slide portion 20. A reduced-diameter portion 30 includes an abutment ledge 32, the hidden portion of which is shown in dashed line. Reduced-diameter portion 30 accommodates the thickness of material of sleeve 14 and limits the operational position of sleeve 14.

Figure 4:
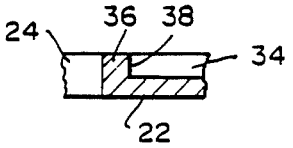
FIG. 4 is a cross section taken along IV—IV in FIG. 2.
Figure 5:
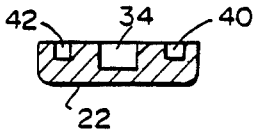
FIG. 5 is a cross section taken along V—V in FIG. 2.

Referring now momentarily to FIGS. 4 and 5, a control slot 34 includes a stop boss 36 at an inner end thereof. A stop surface 38 on stop boss 36 faces control slot 34. Control slot 34, stop boss 36 and stop surface 38 are employed by utility knife 10 in controlling whether or not a new blade 18 may be selected from trapezoidal reservoir 24, as will be explained. First and second rectangular guide slots 40 and 42 are disposed in reservoir portion 22 for engagement by correspondingly shaped guide ribs (not shown) extending from blade-slide portion 20.

Referring again to FIG. 3, a reduced-diameter portion 44 terminates at its inner end in an abutment ledge 46 corresponding, respectively, to reduced-diameter portion 30 and abutment ledge 32 of reservoir portion 22 (FIG. 2). A rectangular control slot 48 is disposed longitudinally in body 12. A control rib 50 is disposed adjacent to control slot 48. A longitudinal edge 52 is disposed on control rib 50. A mode-change slot 54 extends transverse to control slot 48 into control rib 50. Chamfers 56 and 58, at opposed sides of mode-change slot 54, provide guidance thereinto.

Figure 6:
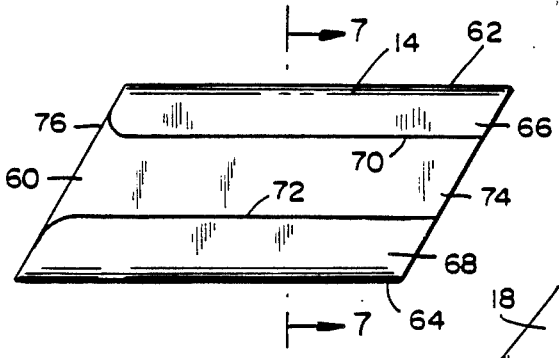
FIG. 6 is a side view of a sleeve of FIG. 1.
Figure 7:
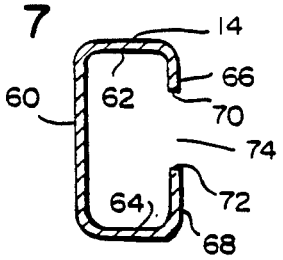
FIG. 7 is a cross section taken along VII—VII in FIG. 6.

Referring now to FIGS. 6 and 7, sleeve 14 is a generally C-shaped member in cross section with a back 60, two opposed end surfaces 62 and 64, and two wings 66 and 68 extending toward each other. Wings 66 and 68 terminate in edges 70 and 72 defining a gap 74 therebetween. An end 76 includes an inclination substantially equal to an inclination of abutment ledge 32 (FIG. 2)

and abutment ledge 46 (FIG. 3). The position and dimension of gap 74 permit sleeve 14 to slide onto reduced-diameter portion 30 and reduced-diameter portion 44 of blade-slide portion 20 and reservoir portion 22 with edge 70 guided along longitudinal edge 52 and edge 72 just clear of control slot 48. This assembled relationship is especially clear in FIG. 1. Although not illustrated in the figures, wings 66 and 68 may be angled inward in their unstressed condition. Springback in the metal forming sleeve 14 may then permit wings 66 and 68 to establish a resilient grip on the remainder of utility knife 10 for secure assembly thereof. In addition, frictional contact with the exterior of sleeve 14 may be improved by knurling on it surface or slots therethrough (both of which are conventional and thus are not shown).

Figure 8:
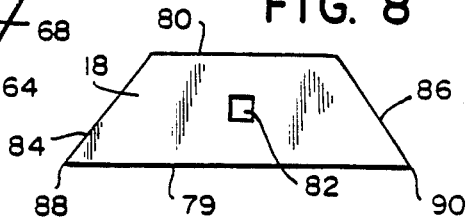
FIG. 8 is a side view of a blade suitable for use in the utility knife of FIG. 1.

Referring now to FIG. 8, blade 18 includes a cutting edge 79 at one side thereof and a back edge 80 at the opposed side thereof. An aperture notch or locking hole 82 is disposed in blade 18. The outline of blade 18 may be of any convenient shape including rectangular. One common outline shape is the illustrated regular trapezoidal shape having first and second angled edges 84 and 86 meeting cutting edge 79 at acute angles 88 and 90, respectively. One skilled in the art, with the present disclosure for reference, will understand that the size, shape and position of locking hole 82 may be varied at will with corresponding changes in mating elements (described later) in utility knife 10. In particular, locking hole 82 may be replaced by one or more notches (not shown) extending inward from back edge 80 without departing from the spirit and scope of the invention.

Figure 9:
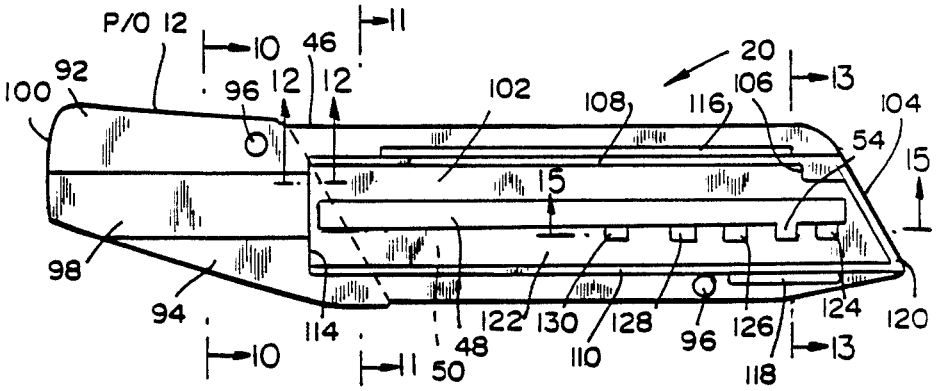
FIG. 9 is an inside view of the blade-slide portion of FIG. 3.

Referring now to FIG. 9, blade-slide portion 20 is shown rotated 180 degrees about its longitudinal axis to reveal internal details. It should be noted that elements in FIG. 9 are up-down inverted from corresponding elements in the other figures. An upper planar surface 92 outlines substantially all of an upper edge of blade-slide portion 20 as seen in the figure. Similarly, a lower planar surface 94 outlines substantially all of a lower edge of blade-slide portion 20 as seen in the figure. Cylindrical posts 96 extend outward from the plane of the figure for engagement in cylindrical cavities 28 of reservoir portion 22 (FIG. 2). With such engagement accomplished, upper planar surface 92 and lower planar surface 94 are disposed in abutment with planar face 26 (FIG. 2).

Figure 10:
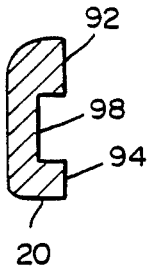
FIG. 10 is a cross section taken along X—X in FIG. 9.
Figure 11:
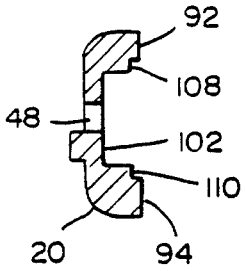
FIG. 11 is a cross section taken along XI—XI in FIG. 9.

Referring now also to FIG. 10, a tail slot 98 extends through a rear end 100 of blade-slide portion 20. Referring now also to FIG. 11, a head slide 102 is disposed adjacent an inner end of tail slot 98 and extends almost to a forward end 104 of blade-slide portion 20. An abutment stop 106 is disposed near forward end 104. It will be noted that control slot 48 is centrally disposed in head slide 102, extending almost the full length thereof. First and second blade-guide steps 108 and 110, disposed adjacent opposed edges of head slide 102, together form a blade guide for slidably guiding the opposed edges of a blade 18 (not shown in the presently referenced figures).

Figure 12:
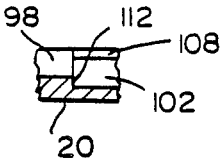
FIG. 12 is a cross section taken along XII—XII in FIG. 9.

Referring now to FIG. 12, head slide 102 is substantially deeper than tail slot 98, thus forming a step 112 at the junction thereof. In FIG. 9, it will be noted that head slide 102 is also wider than tail slot 98, thus forming an end wall 114 at the junction thereof.

Figure 13:
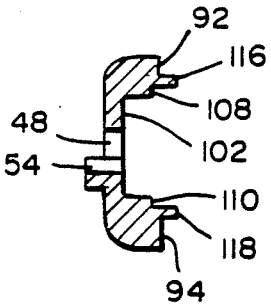
FIG. 13 is a cross section taken along XIII—XIII in FIG. 9.

Referring now also to the cross section of blade-slide portion 20 in FIG. 13, a long locating rib 116 projects from upper planar surface 92 immediately adjacent blade-guide step 108. A short locating rib 118 projects from lower planar surface 94 immediately adjacent blade-guide step 110. Referring momentarily to FIG. 2, long locating rib 116 fits guidingly into guide slot 40 and short locating rib 118 fits guidingly into guide slot 42. One skilled in the art will recognize the value of long locating rib 116 and short locating rib 118 in their locations since they provide positive protection against a blade 18 (not shown in the presently referenced figures) sliding out of a crack formed between planar face 26 and abutting surfaces of upper planar surface 92 and lower planar surface 94.

Figure 14:
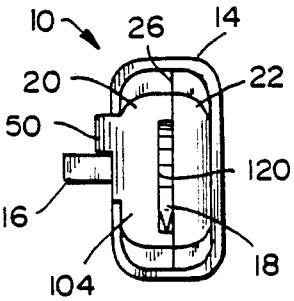
FIG. 14 is an end view taken in a direction XIV—XIV in FIG. 1.

Referring now to the end view of utility knife 10 in FIG. 14, forward end 104 of blade-slide portion 20 contains a rectangular depression 120 which, with planar face 26 of reservoir portion 22, forms a slot through which blade 18 may be moved into its operational position shown in FIG. 1.

Figure 15:
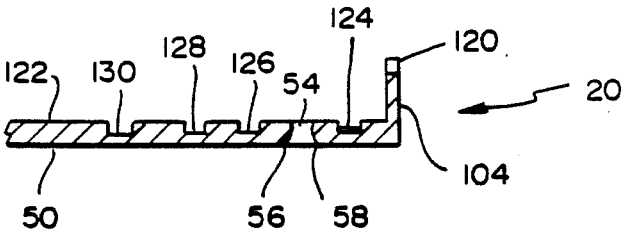
FIG. 15 is a cross section taken along XV—XV in FIG. 9.

Referring now to FIGS. 9 and 15, an inner surface 122 of blade-slide portion 20 opposed to control rib 50, contains a plurality, suitably three, operational lock wells 124, 126 and 128, and a retraction lock well 130. Operational lock wells 124, 126 and 128 are suitably of rectangular cross section. Retraction lock well 130 may optionally also have a greater depth than operational lock wells 124, 126 and 128 in order to improve the positiveness of locking. The functions of operational lock wells 124, 126 and 128, and of retraction lock well 130, will be detailed hereinafter.

Figure 16:
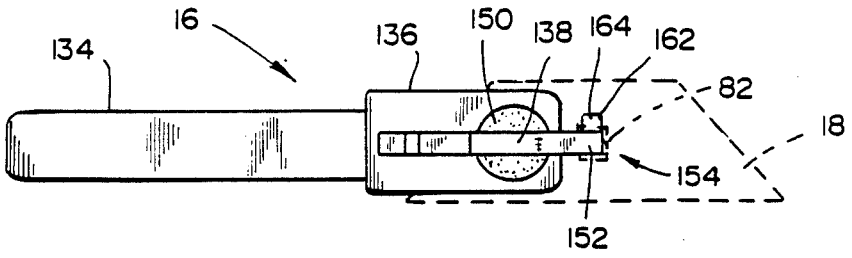
FIG. 16 is a top view of a slide of FIG. 1.
Figure 17:
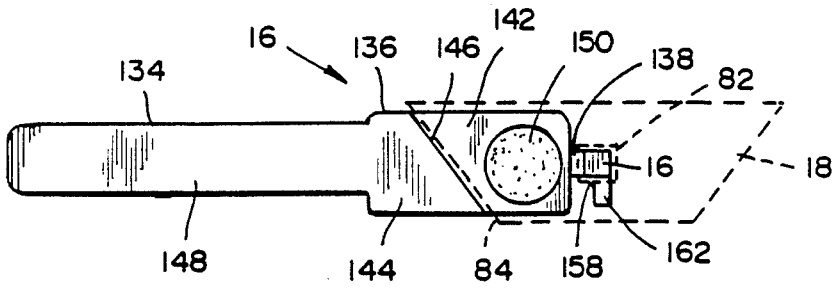
FIG. 17 is a bottom view of a slide of FIG. 1.
Figure 18:
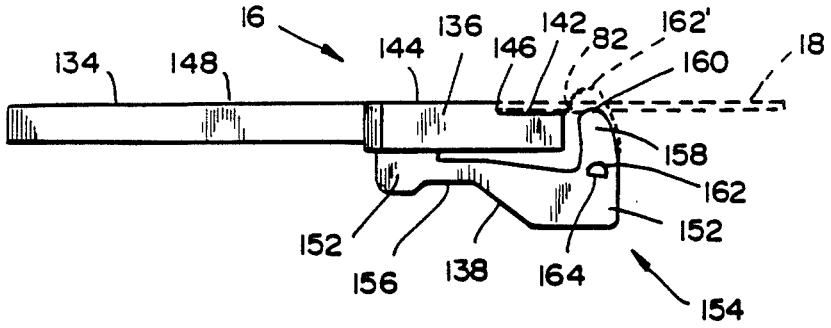
FIG. 18 is a side view of a slide of FIG. 1.

Referring now to FIGS. 16, 17 and 18, slide 16 cooperates with the remainder of utility knife 10 to obtain a single blade 18 from trapezoidal reservoir 24 of reservoir portion, transport it to, and lock it into, a selectable one of a plurality of operational positions or a retracted position, to release a blade 18 in order to permit its reversal or its discard, and to prevent another blade 18 from being moved to an operational position until a previously operational blade 18 is removed.

Slide 16 includes a generally rectangular tail 134, a generally rectangular head 136 and a cantilevered lever 138. As best seen in FIGS. 16 and 17, tail 134 is narrower than head 136. In addition, as best seen in FIG. 18. tail 134 is also thinner than head 136. A forward surface portion 142 of head 136 is recessed from a rear surface portion 144 thereof by a dimension substantially equal to a thickness of a blade 18. Forward surface portion 142 and rear surface portion 144 meet at a diagonal step 146 having an angle substantially equal to the angle made by an edge of blade 18. The surface of rear surface portion 144 is substantially coplanar with an adjacent surface 148 of tail 134. The illustrated embodiment of the invention conforms to the teaching of my prior referenced patent, whereby a permanent magnet 150 is embedded in forward surface portion 142 with its surface generally coplanar with forward surface portion 142.

Cantilevered lever 138 is affixed to head 136 at an attachment point 152 for supporting a cantilevered portion 154 resiliently joined thereto by a thinned spring portion 156. Cantilevered portion 154 includes a tooth or dog 158 which, in the operational relationship between slide 16 and blade 18, aligns a tip 160 with locking hole 82. Dog 158 preferably includes tapered edges for reducing the precision of positioning required to attain penetration of locking hole 82. A control peg 162 extends from one side of attachment point 152. Control peg 162 may have any convenient cross-sectional shape including rectangular or circular, however, a circular shape with a flat surface 164 disposed facing away from tip 160 offers functional advantages.

Referring specifically to FIG. 18, dog 158 has a locking position, shown in dashed line, wherein it penetrates a substantial distance through locking hole 82 for positive mechanical lock of blade 18 to slide 16. In its solid-line unlocking position, dog 158 is withdrawn from locking hole 82 whereby blade 18 may be separated from slide 16 by sliding it in a direction parallel to its plane. Blade removal is preferably performed with slide 16 in its fully rightward position with control peg 162 resting on the outer surface of control rib 50 rightward of mode-change slot 54. Even when unlocked, however, diagonal step 146 prevents blade 18 from being moved further to the left in FIGS. 16–18. In addition, permanent magnet 150 attracts blade 18 toward it with a force effective for retaining blade 18 in a stationary position with respect to slide 16 by friction therebetween until blade 18 is slid positively toward the right, as by a user grasping and pulling it free.

Referring now also to FIG. 9, slide 16 is installed in blade-slide portion 20 with tail 134 positioned in tail slot 98, head 136 positioned in head slide 102, and part of cantilevered lever 138 passing through control slot 48. Reservoir portion 22 (FIG. 2) may then be installed on blade-slide portion 20 and slide 16, and the entire assembly of utility knife 10 may be completed by sliding sleeve 14 into place over blade-slide portion 20 and reservoir portion 22. A supply of blades 18 may be installed in trapezoidal reservoir 24 before sleeve 14 is fully engaged.

Operation of utility knife 10 may be divided into positioning a blade 18 in one of a plurality of operational positions and a retracted position, in loading a blade 18, and in releasing a blade 18 for reversal or disposal. For establishing all operational and retracted positions, control peg 162 is disposed within head slide 102 in engagement with one of operational lock wells 124, 126, or 128 or with retraction lock well 130. A resilience provided by thinned spring portion 156 is effective for maintaining positive engagement in any of these positions.

Referring now to FIGS. 19 and 20, in any of the operational positions or the retracted position, dog 158 is urged through and beyond locking hole 82 into control slot 34. In its forward-most position (FIG. 19), dog 158 is stopped by contact with forward end 104. This is the fully extended position shown in FIG. 1. Blade 18 is held firmly by dog 158 in this condition and cannot be removed. In its rear-most position in which blade 18 is fully retracted into utility knife 10 (FIG. 20), dog 158 is stopped by contact with stop surface 38 of stop boss 36. Even if blade 18 is not installed on head 136 at this time, the thickness of head 136 at rear surface portion 144 holds a leading blade 18 within trapezoidal reservoir 24 rather than permitting it to move into an interfering position.

Referring also momentarily to FIGS. 1 and 9, loading and/or release of a blade 18 is performed by sliding slide 16 until control peg 162 is aligned with mode-change slot 54 (FIGS. 1 and 9) and pulling upward on cantilevered portion 154 until control peg 162 is disposed on the outside of blade-slide portion 20. This action withdraws dog 158 from locking hole 82 (FIGS. 19 and 20), as well as moves it out of possible contact with stop surface 38 of stop boss 36. Sliding cantilevered lever 138 forward or backward out of alignment with mode-change slot 54 permits control peg 162 to slide along the outside of control rib 50 (FIG. 1). With dog 158 removed from locking hole 82, blade 18 may be removed from utility knife 10 by pulling forward thereon. Blade 18 may be discarded or may be reversed and reinserted onto forward surface portion 142. Magnet-induced friction between abutting surfaces of blade 18 is sufficient to maintain blade 18 in aligned contact with forward surface portion 142, while head 136 is drawn backward into utility knife 10 for engaging locking hole 82 with dog 158.

Referring now to FIG. 21, at any time except when slide 16 is in position to load a blade 18, tail 134 faces a leading blade 18 in trapezoidal reservoir 24. The thickness of tail 134 is great enough that the leading blade 18 is prevented from moving into contact with blade-guide step 108 and blade-guide step 110 and is thus retained in trapezoidal reservoir 24.

Referring now to FIG. 22, when slide 16 is moved into its loading position, forward surface portion 142 of head 136 faces trapezoidal reservoir 24. Forward surface portion 142, being recessed from the remainder of slide 16, permits the leading blade 18 to move into contact with blade-guide step 108 and blade-guide step 110 and to be moved forward into may be captured as previously described.

Referring now to FIG. 23, utility knife 10 is shown in the loading condition of FIG. 22. It will be noted that cantilevered lever 138 is in its fully leftward position and control peg 162 is disposed on the outside supported by control rib 50. Tail 134 of slide 16 is shown protruding from utility knife 10 in this condition. Such protrusion is not a necessary element of utility knife 10 but is conveniently availed of in order to reduce the required lengths of blade-slide portion 20 and reservoir portion 22. Alternatively, these elements could be made long enough to contain all of tail 134 in its loading position.

One skilled in the art, with the guidance of the present disclosure, will recognize that the use of permanent magnet 150 (FIGS. 16, 17 and 22) to aid in urging the leading blade 18 toward slide 16 is a convenient way to accomplish this effect. The invention should not be considered to be limited to such an embodiment, however. It is contemplated that the attractive urging of permanent magnet 150 could be replaced by repulsive urging of a spring (not shown) behind the trailing blade 18 in trapezoidal reservoir 24 without departing from the spirit and scope of the invention. Indeed, embodiments of the invention having both permanent magnet 150 and a spring are foreseen. In addition, both permanent magnet 150 and a spring may be omitted from an embodiment which relies on gravity for urging blade 18 into contact with slide 16.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A knife comprising (a) a first body portion, including blade retaining means for retaining a stack of knife blades therein;

(b) a second body portion matable with said first body portion to provide a knife housing including a blade opening, said second body portion including an inner surface having a plurality of locking wells disposed parallel to a predetermined direction within said knife housing; and (c) a unitary slide member slidably disposed for motion in said predetermined direction within said knife housing, said unitary slide member including blade control means for controlling the removal of a single blade located in a predetermined plane from said stack of blades, blade engagement means for engaging said single blade in a fixed position with respect to said unitary slide member whereby said single blade may be slidably moved within said predetermined plane between at least one operative position projecting through said blade opening and a retracted position within said knife housing, and locking means for locking said unitary slide member in a plurality of fixed positions, including said at least one operative position, said locking means comprising control peg means projecting from said blade engagement means, said blade engagement means being movable between a first blade engaging position in which said control peg means is disposed in one of said plurality of locking wells, and a second blade engaging position in which said control peg means is displaced from said plurality of locking wells, whereby said unitary slide member may be slidably moved to a position in which said control peg means is located at a position corresponding to one of said locking wells, without disengaging said blade engagement means from said blade.

2. The knife of claim 1 wherein said knife blades include at least one aperture, and wherein said blade engagement means comprises tooth means, said tooth means being movable between a first position within said predetermined plane and a second position outside of said predetermined plane, whereby when said tooth means is in said first position said tooth means may enter and engage said at least one aperture in said blade, and when said tooth means is in said second position said tooth means does not enter said at least one aperture in said blade.

3. The knife of claim 2 wherein said unitary slide member includes control means for selectively maintaining said tooth means in said second position, whereby when said tooth means is in said second position said toothe means is disengaged from said blade.

4. The knife of claim 1 wherein said blade control means comprises a head portion including a first surface disposed parallel to said predetermined plane when said unitary slide member is disposed within said knife housing, and a recessed portion including a second surface disposed parallel to said first surface, said second surface being displaced from said first surface by a distance substantially corresponding to the thickness of said single blade whereby said slidable movement of said unitary slide member across said stack of blades in said predetermined plane can effect the removal of said single blade therefrom.

5. The knife of claim 4 wherein said control means further includes magnet means disposed in said second surface to maintain said single blade thereagainst.

6. The knife of claim 1 wherein said knife blades include at least one aperture, and wherein said blade engagement means comprises tooth means, said tooth means being movable between a first position within said predetermined plane and a second position outside of said predetermined plane, whereby when said tooth means is in said first position said tooth means may enter and engage said at least one aperture in said blade, and when said tooth means is in said second position said tooth means does not enter said at least one aperture in said blade.

7. The knife of claim 6 wherein said tooth means and said control peg means are resiliently attached to said unitary slide member whereby said tooth means and said control peg means are resiliently urgeable into said first and second positions, and said first and second blade engaging positions, respectively.

8. The knife of claim 7 wherein said second body portion includes a control slot whereby said control peg means can pass through said control slot, with said first position of said knife engagement means being located within said housing and said second position for said blade engagement means being located outside of said housing.

9. A knife comprising (a) a first body portion, including blade retaining means for retaining a stack of knife blades therein;

(b) a second body portion matable with said first body portion to provide a knife housing including a blade opening, said first and second body portions providing a knife housing having a first portion with a first circumference and a second portion with a second circumference, said second circumference being greater than said first circumference;

(c) a slide member slidably disposed within said knife housing, said slide member including blade engagement means for engaging a single blade from said stack of knife blades in a fixed position with respect to said slide member whereby said single blade may be slidably moved between at least one operative position through said blade opening and a retracted position within said housing; and (d) sleeve means having a generally C-shaped configuration slidable over said first and second body portions whereby when said sleeve means slides over said first and second body portions said first and second body portions are retained in said mating configuration so as to provide said knife housing, said sleeve means having an inner configuration adapted to fit over said first circumference and not sufficiently large to fit over said second circumference.

10. The knife of claim 9 wherein said second circumference is defined by a depending wall portion, whereby said sleeve means abuts against said depending wall portion upon fitting said sleeve means over said portion of said first and second body portions having said first circumference.

11. The knife of claim 9 wherein said knife blades include at least one aperture, and wherein said blade engagement means comprises tooth means, said tooth means being movable between a first position and a second position, whereby when said tooth means is in said first position said tooth means may enter and engage said at least one aperture in said blade, and when said tooth means is in said second position said tooth means does not enter said at least one aperture in said blade.

12. The knife of claim 11 wherein said slide member includes control means for selectively maintaining said tooth means in said second position, whereby when said tooth means is in said second position said tooth means is disengaged from said blade.

13. The knife of claim 12 including locking means for locking said slide member in a plurality of fixed positions, including said at least one operative position, without disengaging said blade engagement means from said blade.

14. The knife of claim 13 wherein the inner surface of said second body portion includes a plurality of locking wells, and wherein said locking means comprises control peg means projecting from said blade engagement means, said blade engagement means being movable between a first blade engaging position in which said peg means is disposed in one of said plurality of locking wells and a second blade engaging position in which the peg means is displaced from said plurality of locking wells, whereby said slide member may be slidably moved to the position in which said peg means is located at a position corresponding to one of said locking wells.

15. The knife of claim 14 wherein said control means includes an aperture in said second body portion, whereby said control peg means can be maintained outside of said knife housing by passing said control peg means through said aperture in said second body portion.

16. The knife of claim 15 wherein said sleeve means has a generally C-shaped configuration including an opening and is slidable over said first and second body portions to effect the mating thereof.

17. The knife of claim 16 wherein said opening in said C-shaped configuration of said sleeve means corresponds to said aperture in said second body portion when said sleeve means is fitted over said first and second body portions.

18. A knife comprising (a) a first body portion, including blade retaining means for retaining a stack of knife blades therein;

(b) a second body portion matable with said first body portion to provide a knife housing including a blade opening; and (c) a unitary slide member slidably disposed for motion in a predetermined direction within said knife housing, said unitary slide member including blade control means for controlling the removal of a single blade located in a predetermined plane from said stack of blades, blade engagement means for engaging said single blade in a fixed position with respect to said unitary slide member whereby said single blade may be slidably moved within said predetermined plane between at least one operative position projecting through said blade opening and a retracted position within said knife housing, and locking means for locking said unitary slide member in a plurality of fixed positions, including said at least one operative position, without disengaging said blade engagement means from said blade, said blade control means comprising a head portion including a first surface disposed parallel to said predetermined plane when said unitary slide member is disposed within said knife housing, and a recessed portion including a second surface disposed parallel to said first surface, said second surface being displaced from said first surface by a distance substantially corresponding to the thickness of said single blade whereby said slidable movement of said unitary slide member across said stack of blades in said predetermined plane can effect the removal of said single blade therefrom.

19. The knife of claim 18 wherein said control means further includes magnet means disposed in said second surface to maintain said single blade thereagainst.

20. A knife comprising (a) a first body portion, including blade retaining means for retaining a stack of knife blades including at least one aperture therein;

(b) a second body portion matable with said first body portion to provide a knife housing including a blade opening, said second body portion including an inner surface having a plurality of locking wells disposed parallel to a predetermined direction within said knife housing; and (c) a unitary slide member slidably disposed for motion in said predetermined direction within said knife housing, said unitary slide member including blade control means for controlling the removal of a single blade located in a predetermined plane from said stack of blades, blade engagement means for engaging said single blade in a fixed position with respect to said unitary slide member whereby said single blade may be slidably moved within said predetermined plane between at least one operative position projecting through said blade opening and a retracted position within said knife housing, and locking means for locking said unitary slide member in a plurality of fixed positions, including said at least one operative position, without disengaging said blade engagement means from said blade, said locking means comprising control peg means projecting from said blade engagement means, said blade engagement means being movable between a first blade engaging position in which said peg means is disposed in one of said plurality of locking wells, and a second blade engaging position in which said peg means is displaced from said plurality of locking wells, whereby said unitary slide member may be slidably moved to a position in which said peg means is located at a position corresponding to one of said locking wells, said blade engagement means further comprising tooth means movable between a first position within said predetermined plane and a second position outside of said predetermined plane, whereby when said tooth means is in said first position said tooth means may enter and engage said at least one aperture in said blade, and when said tooth means is in said second position said tooth means does not enter said at least one aperture in said blade, said tooth means and said control peg means being resiliently attached to said unitary slide member whereby said tooth means and said control peg means are resiliently urgeable into said first and second positions, and said first and second blade engaging positions, respectively.

21. The knife of claim 20 wherein said second body portion includes a control slot whereby said control peg means can pass through said control slot, with said first position of said knife engagement means being located within said housing and said second position for said blade engagement means being located outside of said housing.

22. A knife comprising (a) a first body portion, including blade retaining means for retaining a stack of knife blades including at least one aperture therein;

(b) a second body portion including a plurality of locking wells matable with said first body portion to provide a knife housing including a blade opening;

(c) a slide member slidably disposed within said knife housing, said slide member including blade engagement means for engaging a single blade from said stack of knife blades in a fixed position with respect to said slide member whereby said single blade may be slidably moved between at least one operative position through said blade opening and a retracted position within said housing, said blade engagement means comprising tooth means movable between a first position and a second position, whereby when said tooth means is in said first position said tooth means may enter and engage said at least one aperture in said blade, and when said tooth means is in said second position said tooth means does not enter said at least one aperture in said blade, said slide member including control means for selectively maintaining said tooth means in said second position, whereby when said tooth means is in said second position said tooth means is disengaged from said blade;

(d) sleeve means fittable over said first and second body portions whereby when said sleeve means is fitted over said first and second body portions said first and second body portions are retained in said mating configuration so as to provide said knife housing; and (e) locking means for locking said slide member in a plurality of fixed positions, including said at least one operative position, without disengaging said blade engagement means from said blade, said locking means comprising control peg means projecting from said blade engagement means, said blade engagement means being movable between a first blade engagement position in which said peg means is disposed in one of said plurality of locking wells and a second blade engagement position in which said peg means is displaced from said plurality of locking wells, whereby said slide member may be slidably moved to the position in which said peg means is located at a position corresponding to one of said locking wells, said control peg means being maintainable outside of said knife housing by passing said control peg means through said aperture in said second body portion.

23. The knife of claim 22 wherein said sleeve means has a generally C-shaped configuration including an opening and is slidable over said first and second body portions to effect the mating thereof.

24. The knife of claim 23 wherein said opening in said C-shaped configuration of said sleeve means corresponds to said aperture in said second body portion when said sleeve means is fitted over said first and second body portions.

* * * * *